United States Patent [19]

Wilson et al.

[11] 3,932,146

[45] Jan. 13, 1976

[54] PROCESS FOR THE FLUID BED GASIFICATION OF AGGLOMERATING COALS

[75] Inventors: Edward L. Wilson; Willard N. Mitchell; Hermann E. von Rosenberg, all of Baytown, Tex.

[73] Assignee: Exxon Research and Engineering Company, Linden, N.J.

[22] Filed: July 11, 1974

[21] Appl. No.: 487,516

[52] U.S. Cl. ..... 48/210; 48/202; 252/373

[51] Int. Cl.[2] ..... C10J 3/54

[58] Field of Search ..... 201/9, 22, 24, 31; 48/202, 48/203, 206, 210, 197 R; 252/373

[56] References Cited

UNITED STATES PATENTS

| | | | |
|---|---|---|---|
| 1,954,351 | 4/1934 | Dornbrook et al. | 201/9 |
| 2,577,632 | 12/1951 | Roetheli | 48/203 |
| 2,654,661 | 10/1953 | Gorin | 48/210 |
| 2,729,598 | 1/1956 | Garbo | 201/9 |
| 3,847,566 | 11/1974 | Wilson | 48/202 |

FOREIGN PATENTS OR APPLICATIONS

| | | | |
|---|---|---|---|
| 672,477 | 5/1952 | United Kingdom | 201/9 |
| 697,167 | 9/1953 | United Kingdom | 48/197 |

*Primary Examiner*—S. Leon Bashore
*Assistant Examiner*—Peter F. Kratz
*Attorney, Agent, or Firm*—Yale S. Finkle; James E. Reed

[57] ABSTRACT

Feed coal particles are mixed with fine particles of devolatilized carbonaceous material having an average particle diameter less than about 25% of that of the coal and then injected into a high temperature fluidized bed gasification zone. The devolatilized material adheres to the coal particles as they soften and forms a nonsticky coating which hinders the formation of large coal agglomerates. During the gasification process the adhering particles are retained in the bed and at least partially gasified, resulting in better carbon utilization than might otherwise be obtained.

10 Claims, 1 Drawing Figure

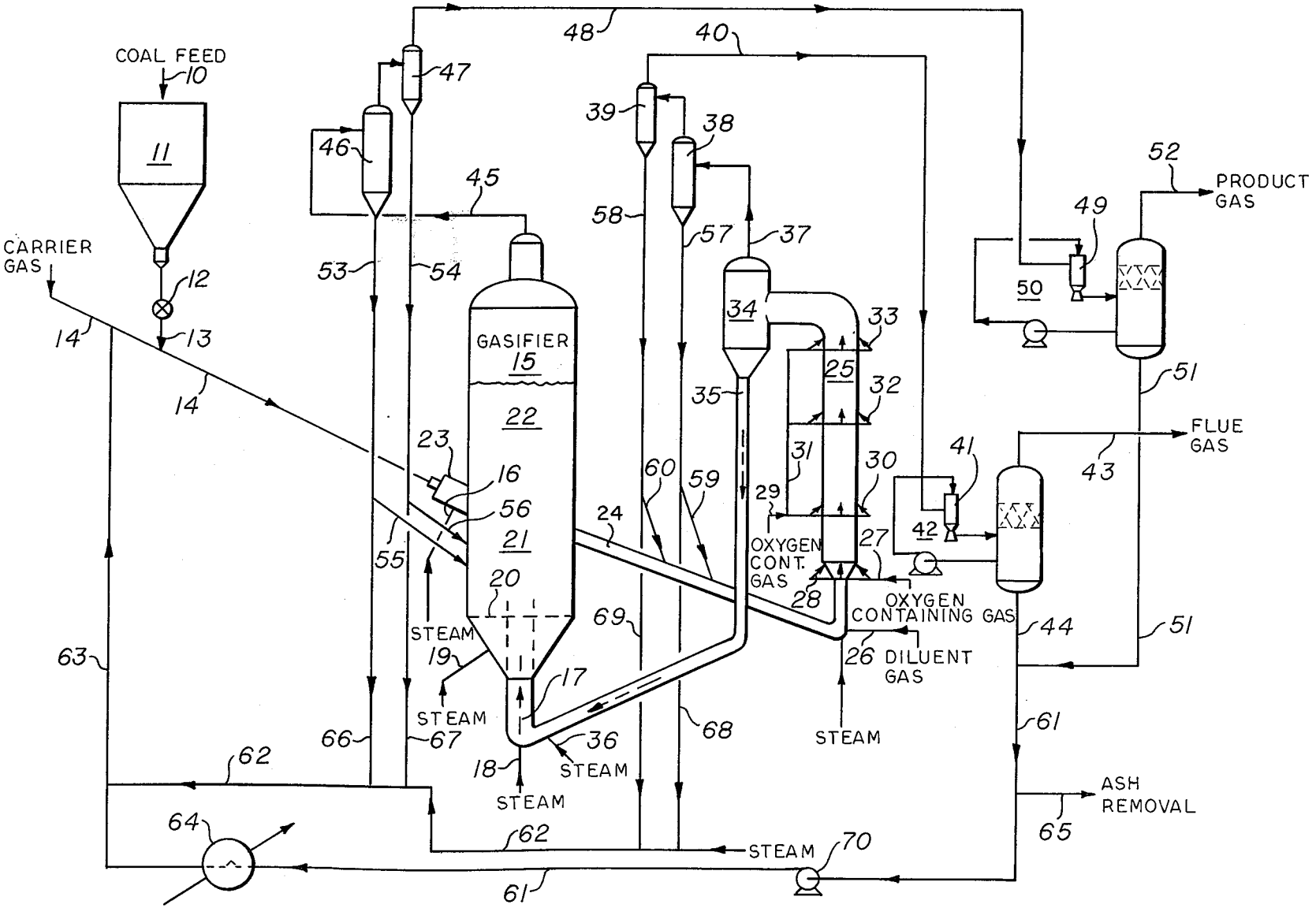
PRODUCT GAS
FLUE GAS
ASH REMOVAL
OXYGEN CONTAINING GAS
DILUENT GAS
STEAM
OXYGEN CONT. GAS
GASIFIER 15
COAL FEED
CARRIER GAS

PROCESS FOR THE FLUID BED GASIFICATION OF AGGLOMERATING COALS

BACKGROUND OF THE INVENTION

1. Field of the Invention

This invention pertains to the gasification of carbonaceous solids and is particularly concerned with the fluidized bed gasification of agglomerating coals.

2. Description of the Prior Art

The formation of agglomerates is a problem frequently encountered in the fluid bed gasification of caking coals. This is caused by plastic properties which develop when such coals are subjected to temperatures above their softening point. Upon reaching this point, generally between about 700° and about 900° F., the coal particles begin to swell and deform due to the formation of bubbles during devolatilization. As the temperature increases, deformation becomes more severe, the coal becomes plastic and sticky, and may eventually become fragile. The sticky particles tend to agglomerate and form large clusters which interfere with operation of the fluidized bed. The fragile particles break into fragments which are further attrited to produce fines. These fines are entrained in the rising gases and carried overhead from the bed. The fines may contain from 10 to 20 percent of the carbon fed to the process. The loss of this carbon before it can be gasified decreases the efficiency of the process.

The traditional method for dealing with fines produced during gasification operations is to separate them from the product gas and return them directly to the gasifier. This technique, however, is generally unsatisfactory because the returned particles are rapidly entrained in the product gas and carried overhead from the fluid bed at a velocity approximately equal to that of the gas. The residence time of the fines in the reactor is therefore quite short and little additional carbon is gasified.

Several methods have been devised to alleviate agglomeration problems encountered when caking coals are gasified. These involve low temperature carbonization in a pretreating zone, carbonization at progressively higher temperatures in a series of fluidized beds, injection of the coal into the gasifier as a very fine powder, or passage of the coal through a free-fall pretreatment zone in the presence of steam and oxygen. Although these techniques can be useful under certain conditions, they all have pronounced disadvantages. They are either expensive, result in the loss of valuable volatile constituents from the coal, or require the use of complex equipment.

An additional method which has been proposed for controlling agglomeration involves withdrawing char particles from the fluidized bed gasifier, mixing these with raw feed coal of comparable size, and injecting the char particles and coal into the fluidized bed. This procedure is intended to prevent sticky feed coal particles from coming in contact with one another to form agglomerates but large amounts of char must be injected into the fluidized bed with the coal if it is to be effective. Unless the ratio of char to feed coal is large, the probability of coal particles contacting one another to form agglomerates will be very high. Normally, a weight ratio of char to feed coal ranging from 10:1 to 30:1 is required to insure that agglomeration will not interfere with the continuous operation of the gasification process. Moreover, the average particle size of the char will be approximately the same as that of the feed coal. The shear forces in the turbulent fluidized bed are often sufficient to break the relatively weak bonds between the sticky coal particles and devolatilized char particles of comparable size and hence some agglomeration may occur even though the char is present.

Although the technique referred to above may aid in controlling agglomeration, it has pronounced disadvantages. The necessity for withdrawing large quantities of unconsumed char from the fluidized bed gasifier, mixing it with the coal, and then returning the combined stream to the gasifier limits the amount of coal that can be injected into the gasifier, necessitates the inclusion of equipment for withdrawing and handling the hot char particles, reduces the overall char gasification rate in the system, tends to decrease the thermal efficiency of the process, requires the use of higher fluidizing gas velocities than might otherwise be required, and may give rise to other difficulties. As a result, this technique leaves much to be desired.

SUMMARY OF THE INVENTION

This invention provides an improved fluidized bed coal gasification process which alleviates coal agglomeration problems and is considerably more effective than processes proposed in the past. In accordance with the invention, it has now been found that agglomeration can be controlled by combining finely divided, devolatilized carbonaceous material having an average particle diameter less than about 25 percent of that of the coal particles with the raw coal at a temperature below the softening point of the coal and then injecting the mixture of feed coal and fine carbonaceous material into the gasifier. The devolatilized carbonaceous particles injected through the feed nozzles coat and adhere to the feed coal as it softens and becomes plastic. The resulting nonsticky coating prevents the feed coal particles from agglomerating and produces only an insignificant increase in the size of the feed coal particles. In carrying out the process, the feed coal is maintained at a temperature below its softening point as it is transported through the feed line into the gasifier. Otherwise, an interruption in the flow of devolatilized material could cause the particles of ccoal to agglomerate and block the feed line.

The process of the invention has numerous advantages over methods for controlling agglomeration which have been proposed heretofore. The use of fine particles with an average diameter substantially smaller than that of the feed coal permits the injection of smaller quantities of devolatilized material than would be required if char particles of substantially the same size as the feed coal were withdrawn from the gasifier and mixed with the coal, makes possible higher coal injection rates than might otherwise be feasible, results in higher char gasification rates and better thermal efficiency than can be obtained where char withdrawn from the fluidized bed is used, and provides more effective control of agglomeration than can generally be obtained with other methods.

Fine devolatilized carbonaceous particles which have an average particle diameter less than about 25 percent of that of the feed coal particles and are suitable for purposes of the invention can be derived from a variety of different sources. Fluid coke, metallurgical coke, and char removed from the gasifier, for example, can be crushed, screened and employed if desired. It is preferred, however, to recover fines entrained and carried overhead from the gasifier in the raw product gas and employ these as the devolatilized carbonaceous particles. These fines generally have an average particle diameter considerably less than that of the feed coal and can be mixed with the coal without any size reduction or screening. The fines carried overhead are normally removed from the gas by means of cyclone separators and returned to the gasifier through cyclone dip legs. Studies have shown that the returned particles are rapidly entrained in the product gas and again carried overhead at a velocity approximately equal to that of the gas. Their residence time in the gasifier is therefore short and hence little additional carbon is gasified. Mixing the fines with the feed coal rather than returning them directly to the gasifier, not only aids in controlling agglomeration but also increases the residence time of the particles adhering to the feed coal, thus resulting in better carbon utilization and greater process efficiency. These and other advantages make the process of the invention considerably more attractive than processes proposed in the past.

BRIEF DESCRIPTION OF THE DRAWING

The single FIGURE in the drawing is a schematic flow sheet of a fluid bed coal gasification process carried out in accordance with the invention.

DESCRIPTION OF THE PREFERRED EMBODIMENTS

The process depicted in the drawing is one for the production of a synthetic gas by the fluid bed gasification of bituminous coal, sub-bituminous coal, lignite or similar carbonaceous solids which contain volatilizable hydrocarbon constituents and may tend to agglomerate at elevated temperatures. The solid feed material employed in the process is introduced into the system through line 10 from a preparation plant, not shown, in which the coal or other material may be crushed, dried, and screened or from a storage facility which does not appear in the drawing. To facilitate handling of the solid feed material in a fluidized state, the coal or other carbonaceous solid is introduced into the system in a finely divided state, normally less than about 8 mesh on the U.S. Sieve Series.

The system shown in the drawing is operated at elevated pressures and hence the coal introduced through line 10 is fed into vessel 11, from which it is discharged through star wheel feeder or similar device 12 into line 13 at the system operating pressure or a slightly higher pressure. Other apparatus can be used to raise the input coal stream to the required pressure level. The use of such equipment for handling coal and other finely divided solids at elevated pressures has been described in the patent literature and will therefore be familiar to those skilled in the art.

A carrier gas, which can be high pressure steam, product gas, flue gas or the like, is injected into feed line 14 where it entrains the feed coal particles and finely divided carbonaceous solids used to coat the coal and carries them into the gasifier 15. The use of recycle product gas tends to avoid significant reductions in the hydrogen concentration in the gasifier and improve methane yields and is therefore normally preferred. The carrier gas is introduced into the system at a pressure between about 50 and about 1000 pounds per square inch gauge, depending in part upon the pressure at which the gasifier 15 is operated and the nature of the solid feed material utilized. Finely divided devolatilized carbonaceous solids having an average particle diameter less than about 25 percent that of the coal particles are introduced into the gas in line 14 from line 63 and entrained in the gas stream. These solids may be derived from external sources but will preferably be recycled fines recovered from the product gas or flue gas as described hereafter. Alternatively, the fines or other solids may be mixed with the coal or other feed material in vessel 11 and introduced into the gas stream with the feed material.

The feed stream containing the coal or other feed material and fine carbonaceous solids is introduced into the gasifier through one or more shrouded nozzles 23 which may be provided with steam through line 16 to keep the coal and solids at a temperature below 600° F. and thus avoid any possibility of fouling the nozzles. If a caking coal is utilized as the feed material, injection nozzles designed to promote intimate and extremely rapid mixing of the injected material with the hot solids in the gasifier may be employed. Nozzles suitable for this purpose have been described in the prior art.

The gasifier vessel 15 utilized in the system depicted in the drawing contains a fluidized bed of char particles which are introduced into the lower part of the vessel through line 17. Steam for reacting with the char and maintaining the particles in the fluidized state is introduced through lines 18 and 19. The total steam rate will normally vary between about 0.5 and about 2.0 pounds of steam per pound of coal feed. The upflowing steam and char form a fluidized bed which extends upwardly above the distribution grid 20 to a level above the point at which the coal feed is injected into the gasifier. The lower portion of the gasifier above grid 20, indicated by reference number 21, serves as a steam gasification zone. It is here that the steam introduced through lines 18 and 19 reacts with the carbon in the hot char to form synthesis gas in accordance with the reaction: $H_2O + C \rightarrow H_2 + CO$. At the bottom of the reactor the hydrogen concentration in the gaseous phase of the fluidized bed is essentially zero. As the steam ascends through the fluidized char particles, it reacts with the carbon, and the hydrogen concentration in the gaseous phase increases. The temperature in steam gasification zone 21 will normally range between about 1450° and about 1800° F. The gas velocities in the fludized bed will vary between 0.2 and 3.0 feet per second.

The upper part of the fluidized bed in reactor vessel 15, which is designated by reference number 22, serves as a hydrogasification zone. Here the feed coal is devolatilized and a part of the volatile matter produced reacts with hydrogen generated in zone 21 to produce methane as one of the principal products. The coal particles reach the softening point as they emerge from the nozzles and become coated with the fine carbonaceous solids almost instantaneously. The fines adhere to the sticky particles of coal and prevent them from forming large coal agglomerates. This behavior will be described in more detail hereafter. The point at which the coal feed stream is introduced into the gasifier and thus the location of the steam gasification and hydrogasification zones depends primarily on the properties of the particular coal which is employed as the feedstock. It is generally preferred to maximize the methane yield from the gasifier and minimize the tar yield. Generally speaking, the amount of methane produced increases as the coal feed injection nozzle is moved nearer the top of the reactor. The tar, which has a tendency to foul downstream processing equipment, generally increases as the coal injection point is moved upwardly in the gasifier and decreases as the coal input point is moved nearer the bottom of the reactor, other operating conditions remaining constant. The coal feed should normally be injected into gasifier 15 at a point where the hydrogen concentration in the gas phase is in excess of about 15% by volume, preferably between 25% and 50% by volume.

The upper surface of the fluidized bed will normally be located at a level sufficiently above the feed injection point to provide at least 4 seconds of residence time for the gas phase in contact with the fluidized solids in the hydrogasification zone 22. It is preferred in general that the residence time for the gas in contact with the solid phase above the point of coal feed injection be between 7 and 20 seconds. It will be understood, of course, that the optimum hydrogen concentration at the coal injection point and gas residence time above the point of coal injection will vary with different types and compositions of feed coal and with variations in the gasifier temperature, pressure, steam rate, and other processing conditions. Higher rank coals normally require somewhat more severe reaction conditions to obtain practical reaction rates than do coals of lower rank. Similarly, higher reactor temperatures and steam rates normally tend to increase the hydrogen concentration in the gas phase and thus reduce the solids residence time required for gasification of a given coal feed.

As previously discussed, the temperature in gasifier 15 is normally maintained between about 1450° and about 1800° F. The heat required to sustain the overall endothermic reaction taking place in the gasifier and maintain this operating temperature is provided by withdrawing a portion of the char solids from the fluidized bed through line 24 and passing this material into the lower end of the transfer line burner 25. Steam may be injected into line 24 in the vicinity of the bend in order to promote smooth flow of the solids and avoid any danger of clogging. Similarly, a diluent gas, flue gas for example, may be injected through line 26 to further aid in suspending the solids and entrain them in dilute phase flow as they rise through the transfer line burner. An oxygen-containing gas, preferably a mixture of air and sufficient recycle flue gas to give a molecular oxygen content less than about 10% by volume, is introduced into the lower end of the burner through line 27 and peripherally spaced nozzles 28 in a quantity sufficient to establish dilute phase flow of the solids and initiate combustion of the char particles.

The use of a gas of relatively low oxygen content at the lower end of the burner aids in avoiding the formation of hot spots which may result in localized temperatures that exceed the ash fusion temperature and may lead to the formation of deposits and fouling of the burner. Oxygen containing gas having a higher molecular oxygen content than that introduced in the lower end of the burner may be supplied to the burner through line 29 and peripherally spaced nozzles 30. It is preferable to introduce this additional oxygen-containing gas at two or more vertically spaced levels along the burner in order to achieve a better controlled combustion process and again avoid localized overheating and the problems that may accompany it. In the system shown in the drawing, air or other oxygen-containing gas is introduced at two additional levels by means of line 31 and peripherally spaced nozzles 32 and 33. The levels at which the oxygen-containing gas is introduced into the burner are generally sufficiently separated so that substantially all the oxygen introduced at one level is consumed before the gas and entrained solids reach the next level. This generally provides better control of the temperatures within the burner, results in more efficient combustion, and reduces the carbon monoxide content of the gas stream. The total amount of oxygen introduced in this manner should be sufficient to raise the temperature of solids passing upwardly through the burner by about 50° to about 300° F. and thus provide sufficient heat upon return of the solids to the gasifier to maintain the gasification reactions.

The gases and entrained solids leaving the upper portion of the transfer line burner 25 are passed into a cyclone separator of similar separation unit 34 where the larger solids are removed from the gas stream and returned through dip leg 35 to the gasifier bottom intake line 17. Steam may be introduced into the solids return system through line 36, if desired, to promote proper flow of the solids stream and avoid clogging difficulties. The hot char particles thus returned to the gasifier provide the heat required to sustain both the steam gasification reaction taking place in steam gasification zone 21 and the hydrogasification reactions taking place in hydrogasification zone 22.

The overhead gas stream from separator 34 will contain fine particles of char. To separate these particles from the flue gas, the separator overhead is fed through line 37 to cyclone separators 38 and 39. These separators further decrease the concentration of fine particles in the flue gas. The overhead flue gas stream leaving separator 39 and entering line 40, however, may still contain entrained fine particles of char. To further cleanse the flue gas of fine particulate matter, the overhead stream from separator 39 may be fed through line 40 to a venturi scrubbing system including venturi scrubber 41 and circulating water pump around system 42. Here the flue gas is scrubbed with water and the fines removed from the gas are recovered as a slurry. The slurry exists the pump-around system through line 44 while the flue gas leaves the system for further processing through line 43.

The overhead product gas stream leaving gasifier 15 through line 45 will normally also contain a substantial concentration of fine particulates. The product gas is handled in a manner similar to that in which the flue gas is handled. The gasifier overhead is fed through line 45 to cyclone separators 46 and 47. The overhead from separator 47 enters line 48 and is transported for further fines removal to the venturi scrubbing system including venturi scrubber 49 and water circulating pump-around system 50. Here the fines are separated from the product gas by scrubbing it with water. The resultant slurry is removed from the pump-around system by line 51, while the product gas leaves the system for further processing through line 52.

The fines removed from the product gas stream by cyclone separators 46 and 47 will generally contain a significant amount of ungasified carbon. To obtain additional conversion of this ungasified carbon, the fines may be returned to gasifier 15 through dip legs 53 and 54 and lines 55 and 56. A similar procedure may be followed for the fines removed from the flue gas by separators 38 and 39. These fines can be returned to the transfer line burner to supply carbon fuel for combustion by means of dip legs 57 and 58 and lines 59 and 60. If fines are returned directly to the gasifier, however, they may be rapidly entrained in the upflowing gas and carried overhead from the fluidized bed at a velocity approximately equal to that of the gas. The residence time of the fines in the reactor may be so short that little additional carbon will be gasified.

A preferred procedure which avoids the difficulty pointed out above and results in more efficient conversion of carbon in the gasifier is to pass at least a portion of the fines recovered from the product and flue gas streams through lines 66, 67, 68, and 69 into line 62. Here the fines are entrained in steam and recycled through line 63 to feed line 14 where they are mixed with the feed coal and reinjected into gasifier 15 through nozzle 23.

The recycled fines, devolatilized during their first passage through the gasifier, do not become sticky when again heated to high temperatures in the gasifier but will adhere to the sticky particles of devolatilizing feed coal. This results in a greater residence time than if the fines are recycled directly to the gasifier and hence permits more of the carbon present in the fines to be gasified. At the same time, the fines serve to reduce and control agglomeration problems.

The temperature in feed line 14 should be maintained at a level below the softening point of the feed coal to insure that agglomerates will not form in the feed line if the flow of devolatilized fines into line 14 is interrupted by upsets in the process. The softening point is a function of the composition of the feed coal and is usually above 700° C.

The amount of devolatilized fines recycled to the gasifier with the feed coal is determined primarily by the concentration of fines needed in the feed coal to effectively control agglomeration and the amount of fines produced in the process. The smaller the average particle size of the fines, the fewer the fines that will normally be required to control agglomeration. Under normal operating conditions, a system such as that shown in the drawing may generate fines having an average particle diameter of about 20 microns from a feed coal having an average particle diameter of about 350 microns. Such a system can generally be operated at a weight ratio of fines to feed coal as low as 0.1:1 but, since this normally represents only a portion of the total fines produced, a higher ratio is usually preferred. In most cases the mixing of fines and feed coal in weight ratios in excess of 5:1 reduces the amount of feed coal which can be gasified per unit of time to an unduly low level. The preferred range for operation of the system is generally at a weight ratio of fines to feed coal of from about 0.5:1 to about 3:1.

The amount of fines returned to the gasifier with the feed coal may be controlled by regulating the quantity of fines fed from dip legs 53, 54, 57, and 58 to line 62 through lines 66, 67, 68, and 69. If desired, all the fines removed from the product and flue gases by cyclone separators 38, 39, 46 and 47 can be recycled with the feed coal. In most cases, however, flue gas fines will not be recycled without also recycling at least a portion of the product gas fines.

Normally, the fines removed from the flue gas and the product gas by venturi scrubbers 41 and 49, respectively, are continuously withdrawn from the gasification system to control the ash content of the system. The slurries containing these fines, withdrawn from water circulating pump-around systems 42 and 50 through lines 44 and 51 respectively, may be combined in line 61 and removed from the gasification system through ash removal line 65. In the event that the carbon content of the scrubbed fines is such that it becomes desirable to recycle them for further gasification, however, a portion of the slurry in line 61 may be pumped by means of pump 70 to heat exchanger 64 where the water is vaporized. The resultant steam entrains the fines and transports them through line 63 back to feed line 14 where they are mixed with feed coal and reinjected into gasifier 15. The scrubbed fines will not normally be recycled in this fashion without recycling at least a portion of the product and flue gas fines.

It will be apparent from the preceeding discussion that the invention provides an improved process for the gasification of coal which inhibits agglomeration and results in better carbon utilization than might otherwise be obtained. The process is not restricted to coal gasification, however, and can be used in the gasification of lignite and carbonaceous materials containing volatilizable hydrocarbons. Similarly, although the invention has been described primarily in terms of a fluid bed gasifier utilizing external heat generated in a transfer line burner, it should be understood that the process is not limited to this particular system and can be used with other systems using fluidized bed combustion zones and the like. It may also be used in a fluidized bed gasification process in which heat is generated internally by injecting oxygen or air directly into the gasifier and burning a portion of the carbon contained in the char particles. As indicated earlier, the fines mixed with the feed coal will preferably be particles removed from the product and flue gases but can come from other sources as long as the particles are devolatilized and are of the required size.

We claim:

1. In a process wherein carbonaceous solids containing volatilizable hydrocarbons which solids tend to agglomerate at elevated temperatures are fed into a high temperature fluidized bed reactor and gasified to produce a synthetic gas, the improvement which comprises mixing fine particles of devolatilized carbonaceous material having an average particle diameter less than about 25% of that of said carbonaceous solids with said carbonaceous solids in a weight ratio between about 0.1:1 and about 5:1 at a temperature below the softening point of said carbonaceous solids and introducing the resulting mixture of fine particles of devolatilized carbonaceous material and carbonaceous solids at a temperature below said softening point into said fluidized bed reactor.

2. A process as defined by claim 1 wherein said carbonaceous solids comprise particles of an agglomerating coal.

3. A process as defined by claim 1 wherein said fine particles of devolatilized carbonaceous material comprise particles of fluid coke.

4. A process as defined by claim 1 wherein said fine particles of devolatilized carbonaceous material are fines recovered from the gas produced in said fluidized bed reactor.

5. A process as defined by claim 1 wherein said fine particles of devolatilized carbonaceous material are produced by crushing larger char particles withdrawn from said fluidized bed reactor.

6. A process as defined by claim 1 wherein said fine particles of devolatilized carbonaceous material are mixed with said carbonaceous solids in a weight ratio between about 0.5:1 and about 3:1.

7. A process for the gasification of a bituminous coal which comprises:

a. introducing at a temperature below the softening point of said coal a mixture of particles of said coal and fine char having an average particle diameter less than about 25% of that of said coal particles in a weight ratio between about 0.1:1 and about 5:1 into a fluidized bed gasification zone;

b. withdrawing a product gas overhead from said fluidized bed;

c. recovering fine particles of char having an average particle diameter less than about 25% of that of said coal from said product gas; and d. mixing said char particles recovered from said product gas stream with particles of coal to be fed into said fluidized bed gasification zone at a temperature below the softening point of said coal.

8. A process as defined by claim 7 wherein said fine particles of char are mixed with said coal in a weight ratio between about 0.5:1 and about 3:1.

9. A process as defined by claim 7 including the additional steps of: circulating a stream of solid char particles continuously between said fluidized bed gasification zone and a combustion zone; introducing an oxygen-containing gas into said combustion zone in a quantity sufficient to burn a portion of the carbon present in said char particles and raise the temperature of said char particles to a predetermined level; withdrawing flue gas overhead of said combustion zone; recovering fine particles of char having an average particle diameter less than about 25% of that of said coal from said flue gas; and mixing char particles recovered from said flue gas stream with particles of coal to be fed into said fluidized bed gasification zone at a temperature below the softening point of said coal.

10. A process as defined by claim 9 wherein at least part of said fine particles of char recovered from said flue gas is returned to said combustion zone.

* * * * *